United States Patent [19]

Vorona et al.

[11] 4,110,064

[45] Aug. 29, 1978

[54] AIR-JET FURNACE

[76] Inventors: Dmitry Afanasievich Vorona, ulitsa Dm. Ulyanova, 4, korpus 2, kv. 8; Vitaly Ivanovich Chikul, ulitsa Panferova, 8, kv. 170; Alexandr Stepanovich Smirnov, Leninsky prospekt, 73/8, kv. 149, all of Moscow; Olga Semenovna Chikul, ulitsa Uus, 13, kv. 5, Kiviyli, Estonskoi SSR; Boris Ivanovich Tyagunov, ulitsa Panferova, 8, kv. 22, Moscow; Semen Alexandrovich Tager, ulitsa Dm. Ulyanova, 4, korpus 2, kv. 361, Moscow; Nikolai Nikolaevich Shipkov, ulitsa Magdagulovoi, 18, korpus 2, kv. 157, Moscow; Arkady Vitalievich Perepelkin, Kantemirovskaya ulitsa, 5-3, kv. 503, Moscow; Elizaveta Alexeevna Grigorieva, ulitsa Dm. Ulyanova, 4, korpus 2, kv. 8, Moscow, all of U.S.S.R.; Gennady Alexeevich Krasnovsky, deceased, late of Moscow, U.S.S.R.; Tatyana Sergeevna Krasnovskaya, administratrix, 1 Babiegorodsky pereulok, 15/17, kv. 13, Moscow, U.S.S.R.

[21] Appl. No.: 702,085

[22] Filed: Jul. 2, 1976

[30] Foreign Application Priority Data

Jul. 17, 1975 [SU] U.S.S.R. ..... 2155002

[51] Int. Cl.[2] ..... F23M 9/06

[52] U.S. Cl. ..... 431/171; 110/322; 431/116

[58] Field of Search ..... 431/158, 171, 172, 116; 110/97 D

[56] References Cited

U.S. PATENT DOCUMENTS

| | | | |
|---|---|---|---|
| 2,240,161 | 4/1941 | Mueller | 431/171 X |
| 3,963,018 | 6/1976 | Schultz | 431/158 X |

FOREIGN PATENT DOCUMENTS

| | | | |
|---|---|---|---|
| 1,064,607 | 9/1965 | United Kingdom | 431/115 |
| 429,710 | 6/1935 | United Kingdom | 110/97 D |
| 325,367 | 2/1930 | United Kingdom | 110/97 D |

*Primary Examiner*—Edward G. Favors
*Attorney, Agent, or Firm*—Fleit & Jacobson

[57] ABSTRACT

The invention is to be used for afterburning of polydisperse high-ash thermal decomposition residues, as well as in the construction of the first stage of power utility furnaces for burning fuel with a low yield of volatile products and with a low reactivity.

The furnace comprises a chamber having its bottom part narrowing downwards which is provided with an inlet pipe for admission of air and fuel to the chamber, and the top part of the chamber is provided with an outlet pipe for removal of combustion products from the chamber.

A combustion stabilizer is accommodated in the chamber which comprises a blade-type stream swirling device having its blades arranged in the cross-section of the top part of the chamber upstream the outlet pipe in the path of flow of combustion products.

5 Claims, 2 Drawing Figures

AIR-JET FURNACE

Figure 1:
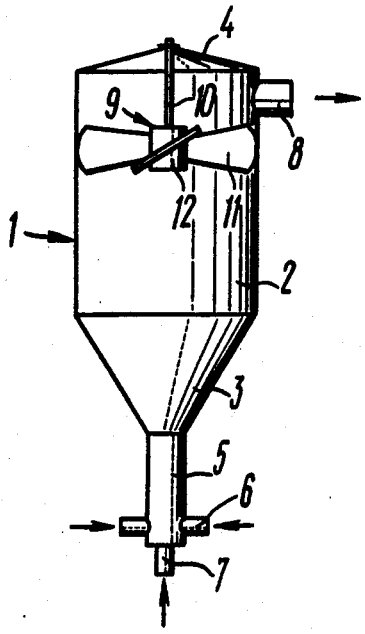

The invention relates to fuel processing and thermal power production techniques, and more specifically to air-jet furnaces for burning solid fuel which are also referred to as aero-fountain furnaces.

The invention may be the most advantageously used in the construction of production furnaces for plants designed for thermal processing of solid fuel, in particular for afterburning of polydisperse high-ash thermal decomposition residues, as well as in the construction of first stages of power plant furnaces for burning fuel with low yield of low-reactivity volatile products.

Evergrowing consumption of fuel in developed countries and in those under development, limited resources of high-grade fuel and non-uniform distribution of deposits of fuel make it necessary, for many countries, to use low-grade fuel in more and more increasing amounts with constant decrease of quality of the fuel used, including such bituminous products which have not even been considered heretofore as the fuel, such as some low-grade shales, bituminous sand and the like.

Burning low-grade fuel in furnaces of steam generators and various production plants (such as heating furnaces) is economically inefficient due to a decrease in the equipment efficiency, need for transportation, storage and handling of larger masses of fuel, as well as because of difficult technical problems and contamination of the environment.

Preliminary thermal processing enables the preparation, from low-grade fuel, of high-grade liquid and gaseous products, which are not only high-grade fuel products, but also excellent starting products for chemical production purposes.

In some applications, especially in processing high-ash fuel, such as shales, solid processing residues containing some amount of combustible products cannot be utilized as fuel due to high ash content. Thus, the semi-coking residues even in case of high-grade shales contains from 2 to 4% of combustible products.

At the same time, the use of ash in the construction industry or in agriculture is also difficult. Combustible products remaining in the ash are noxious because they lower the quality of the ash to be used as binder, filler or for the like purposes.

In these applications, it is expedient to effect afterburning of solid residues in a production furnace of a processing plant so as to provide heat for thermal decomposition of fuel, compensate for losses to the environment, obtain production utility steam, etc.

For that purpose, it is required to have a furnace which enables highly efficient burning of high-ash polydisperse products. Such furnace may comprise an air-jet furnace.

Burning fuel of low reactivity, such as anthracite, is associated with high losses due to mechanical incompleteness of combustion (mechanically incomplete burning), especially in chamber furnaces. This disadvantage becomes more pronounced in power plants in which it is very difficult to implement layer-burning methods, and wherein absolute value of heat losses associated with mechanically incomplete burning are very high. One of the methods aimed at improvement of burning of such fuel is the two-stage combustion method. Thus, at the first stage, a partial gassing, heating and thermal decomposition of fuel are effected to provide for highly efficient afterburning of the resultant products at the second stage.

The first stage for burning low-reactivity fuel may also comprise an air-jet furnace.

Known in the art is an air-jet furnace for burning solid fuel comprising a vertical hollow chamber having its bottom part which narrows downwards and is provided with an inlet pipe for admission of air and fuel, the top part of the furnace having an outlet pipe for removal of combustion products from the furnace (cf. USSR Inventor's Certificate No. 9818 of May 31, 1929, F 23 c, 11/00). These furnaces are, however, deficient in a low degree of fuel circulation in the furnace chamber, high mechanical incompleteness of burning mechanical underburning, and low degree of utilization of air oxygen.

These disadvantages are partially eliminated in an air-jet furnace having a combustion stabilizer means accommodated in the furnace chamber (cf. USSR Inventor's Certificate No. 59432 of Feb. 26, 1939, F 23 c 9/02).

This air-jet furnace comprises a vertical chamber having its bottom part which narrows downwards and is provided with an inlet pipe for admission of air and fuel, the top part of the chamber having an outlet pipe for removal of combustion products from the furnace. The combustion stabilizer means comprises a truncated cone diverging upwards and open at its both ends which is stationary mounted in the bottom part of the chamber.

The combustion stabilizer means of the above-described construction contributes to a certain improvement of fuel circulation in the chamber, but it is not yet sufficient for radical improvement of the furnace performance. The furnace still operates in an unstable mode. Due to non-uniform distribution of fuel and air over the furnace cross-section, zones with elevated temperature are formed in contrast with the average temperature of the furnace thus resulting in slag formation. The furnace performance is characterized by a low thermal stresses, high mechanical underburning, and air-blasting oxygen is not completely utilized.

It is an object of the invention to provide for efficient afterburning of high-ash polydisperse residues of thermal processing of fuel.

Another object of the invention is to provide for thermal preparation of low-reactivity fuel prior to the burning thereof in the second stage of a two-stage furnace.

Still another object of the invention is to improve the reliability of an air-jet furnace in operation.

Further object of the invention is to reduce cost of the construction and operation of an air-jet furnace.

These and other objects are accomplished by that in an air-jet furnace, comprising a vertical chamber having the bottom part which narrows downwards and is provided with an inlet pipe for admission of fuel and air, a top part provided with an outlet pipe for removal of combustion products from the chamber, and a combustion stabilizer means accommodated in the chamber, wherein, according to the invention, the combustion stabilizer means comprises a blade-type mechanical swirling device mounted in the top part of the chamber upstream the outlet pipe in the path of flow of combustion products in such a manner that the blades impart linear and rotary motion to the stream of combustion products.

The air-jet furnace according to the invention enables afterburning of high-ash polydisperse residues of thermal processing of fuel containing 2–4% of combustible products with a low degree of mechanical underburning.

The air-jet furnace according to the invention may be used as the first stage of two-stage furnaces for burning low-reactivity fuel, such as anthracite and the like. In this case, partial gassing of fuel is effected in the air-jet furnace due to the heat of exothermal reactions, and heating and thermal decomposition thereof, thereby providing the conditions for highly efficient afterburning of the resultant products in the second stage of the furnace.

The provision of the combustion stabilizer means in the form of a blade-type mechanical swirling device which is stationary mounted in such a manner that its blades are located in the cross-section of the top part of the furnace upstream the outlet pipe in the flow path of combustion products, enables a stable and uniform repeated internal circulation of the fuel being burned. This provides for an intensive heat supply from the top part of the furnace to the bottom part thereof, rapid heating of fresh fuel with circulating hot fuel and stable ignition and combustion of fuel in the furnace.

Repeated internal circulation of fuel materially prolongs average residence time thereof in the air-jet furnace thereby ensuring deep burning-out of combustible products of high-ash fuel, or gassing and heating of fuel where the air-jet furnace is used as the first stage of a two-stage furnace for burning low-reactivity fuel. In this case, crashed fuel may be burned even without milling.

Repeated internal circulation of fuel particles in the furnace chamber resulting in repeated deceleration and acceleration provides for high velocity of flow of the fuel being burned relative to the oxidation air. Thus the process of gassing and burning of fuel is intensified.

Repeated internal circulation of fuel in the furnace ensures uniform distribution of temperature in the furnace, whereby slag formation is eliminated even when operating the furnace at a temperature near the ash softening point.

In addition, the provision of the above-described combustion stabilizer means ensures an intensive afterburning of fuel and complete utilization of oxygen residue in the fume gas as a result of turbulization of the stream of fuel and fume gas when passing through the stabilizer means.

The provision of the above-described combustion stabilizer means offers an opportunity of obtaining different residence time of particles of polydisperse fuel having different size, in the furnace, because due to different degree of entraning of particles through the stabilizer means, the number of circulation cycles, hence the residence time of coarser particles in the furnace is greater than that of the finer particles. By varying the structural and operation factors, such as angle of blade inclination, blasting velocity and the like, the residence time of fuel particles in the furnace and the ratio of residence time for particles of polydisperse fuel having different size may be varied.

The above features provide for an improved economic efficiency and reliability in operation of the furnace and size reduction, offer an opportunity of efficient afterburning of high-ash fuel thermal decomposition residues containing, e.g. 2–4% of combustible products, and ensure the efficient employment of the air-jet furnace as the first stage of a two-stage furnace for burning low-reactivity fuel.

The swirling device preferably comprises a multiblade propeller having a hub closed at the ends thereof. This construction provides for improved conditions for deviation of fuel particles ascending in the central portion of the chamber towards the chamber wall thereby improving the fuel circulation conditions. In addition, the blade fastening is thereby improved.

The provision of flat blades lowers the wear thereof and simplifies the manufacture. The arrangement of the blades with an angle of inclination to the plane extending normally to the longitudinal axis of the chamber of 15°–60° provides for optimum number of cycles of fuel circulation in the chamber and good turbulization of the combustion products in the combustion stabilizer means.

The suspension of the combustion stabilizer means from the chamber cover plate simplifies the furnace construction and provides for compensation of thermal expansion deformations of the furnace and stabilizer means.

Figure 2:
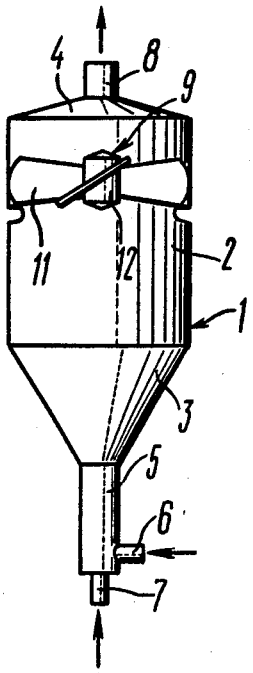

Other objects and advantages of the invention will become apparent from the following detailed description of specific embodiments thereof with reference to the accompanying drawings, in which:

FIG. 1 schematically shows an air-jet furnace according to the invention;

FIG. 2 is an embodiment of fastening of the combustion stabilizer means in the chamber.

The air-jet furnace comprises a vertical chamber 1 (FIG. 1) consisting of two parts: a cylindrical parts 2 and a conical part 3. The chamber 1 is closed at the top by means of a cover plate 4, and at the bottom of the conical part 3 there is provided a pipe 5 having socket pipes 6, 7 for admission of fuel and air, respectively, to the chamber 1. The top portion of the cylindrical part 2 of the chamber has a pipe 8 for removal of combustion products from the chamber 1. A combustion stabilizer means is accommodated in the inner space of the chamber 1 and comprises a multiblade propeller 9 which is stationary suspended from the cover plate 4 of the chamber 1 by means of a suspension 10, the blades 11 of the propeller 9, which are secured to a hub 12 closed at both ends, being arranged in the cross-section of the top part 2 of the chamber 1 upstream the pipe 8 in the flow path of combustion products.

The blades 11 of the propeller 9 are turned about their longitudinal axes in the same direction at an angle from 15° to 60°.

In accordance with another embodiment of the invention, as shown in FIG. 2, the propeller 9 is rigidly secured to a projection 13 of the inner wall of the chamber 1.

The air-jet furnace according to the invention functions in the following manner.

Air for combustion of fuel is continuously fed through the socket pipe 7 to the pipe 5, and fuel is continuously fed through the socket pipe 6. The air entrains fuel particles to accelerate them in the pipe 5 to the velocity required to effect the air-jet operation in the chamber 1. After leaving the pipe 5, when the ascendent stream of fuel suspension in the air flows within the chamber 1, the velocity of fuel particles ascending in the chamber decreases. Then the gaseous suspension flows through the stabilizer — propeller 9. It is noted that only a part of the fuel ascending with the air flow passes through the blades 11 of the propeller 9. Another part of the fuel is projected against the wall of the chamber 1 after the collision with the hub 12 of the blades 11 of the propeller 9 and falls down to the bottom part of the chamber 1, wherein this part of fuel particles meets the ascendent stream of fresh gaseous suspension to be transported by this stream back into the top part of the chamber 1. As a result, a fountain-like movement of fuel particles is effected in the chamber 1 with their repeated circulation within the chamber 1. Carry-away factor of fuel particles through the propeller 9 depends on the particle size. For coarser particles said carry-away factor is smaller than for finer particles. Thus, the number of cycles of circulation, hence, the residence time in the chamber 1 is greater from the coarser fuel particles than finer ones.

With steady circulation conditions, the descending heated fuel particles supply more heat to the bottom part of the chamber 1 and, due to a greater turbulization of the stream, they rapidly heat fresh fuel batch upon meeting the freshly admitted gaseous suspension thus providing for intensification of fuel ignition and burning.

When passing through the propeller 9, the gaseous suspension is swirled, and additional turbulization thereof is effected. Fuel particles collide with the blades 11 and are projected therefrom to cross the flow path of the stream of fume gas formed in the chamber 1. As a result, an intensive afterburning of combustible fuel components and consumption of oxygen residues of the fume gas take place.

By varying the blasting velocity and angle of inclination of the blades 11, the number of cycles of fuel circulation may be varied, and the residence time of fuel particles in the chamber 1 may be thus provided which is required for complete burning-out of the fuel particles, or for preparation thereof for burning in the second stage of the furnace, where the air-jet furnace is used as the first stage of a two-stage furnace.

The stream of the gaseous suspension passed through the combustion stabilizer after the formation from the burning of ash and fume gas, is discharged from the chamber 1 through the pipe 8 to be used as heating medium in power utility or production plants, or is directed to the second stage of the furnace, where the air-jet furnace is used as the second stage of a two-stage furnace.

A specific example of application of the air-jet furnace according to the invention as a heating furnace in a thermal processing plant using shales will be described below for the purposes of illustration.

A mixture of semicoke and ash formed upon thermal processing of shales with a solid heating medium was continuously fed to the air-jet furnace at a rate of 375.3 tons per hour at 500° C., the mixture containing:

| | |
|---|---|
| combustible components | 2.2% |
| including carbon | 1.7% |
| hydrogen | 0.1% |
| pyrite sulphur | 0.4% |
| ash | 72.3% |
| carbonates carbon dioxide | 25.5% |

The lowest combustion heat of the mixture was 175 Kcal/kg.

At the same time, blusting air at 50° C. was fed to the furnace in an amount required for heating gases formed upon burning ash and fume gases at 850° C.

Air discharge rate was 0.85 of the theory required for complete combustion of combustible components of the fuel mixture fed to the furnace.

A part of the ash heated in the furnace (276 tons per hour), which consisted of coarser fraction, was used as heating medium for processing of fresh shales, and finer fraction (72 tons per hour) was removed from the cycle. Fume gas was used for drying fresh shales.

The heating medium contained:

| | |
|---|---|
| ash | 75.2% |
| carbonates carbon dioxide | 24.8% |

The finer fraction contained:

| | |
|---|---|
| ash | 77.0% |
| carbonates carbon dioxide | 22.6% |
| combustible products | 0.4% |

Fume gas contained (in vol. % of dry gas):

| | |
|---|---|
| carbon dioxide | 22.0% |
| air nitrogen | 74.2% |
| methane | 1.6% |
| hydrogen | 1.0% |
| carbon oxide | 1.2% |

What is claimed is:

1. An air-jet furnace comprising: a vertical chamber having a conical bottom part which narrows downwards, an inlet-pipe means for admitting fuel and air to said chamber, means for connecting said inlet pipe means to said narrowing conical bottom part of said chamber, an outlet pipe means for removal of combustion products from said chamber at the top part of said chamber; a combustion stabilizer means stationarily mounted in the inner space of said chamber for repeated recirculation of said fuel in said vertical chamber, said stabilizer means comprising a blade-type mechanical swirling device, the blades of said swirling device being arranged across the chamber in the top part thereof upstream of said outlet pipe in the path flow of combustion products wherein said swirling device comprises a multiblade propeller having a hub closed at both ends thereof said closed-end hub adapted to deflect the flow of combustion products upward.

2. An air-jet furnace according to claim 1, wherein each blade of said multiblade propeller is flat.

3. An air-jet furnace according to claim 1, wherein each blade of said multiblade propeller is inclined to the plane extending normally to the longitudinal axis of the chamber at an angle from 15° to 60°.

4. An air-jet furnace according to claim 1, wherein said chamber includes a cover plate at the top part of said chamber and wherein said combustion stabilizer means is suspended from said cover plate of the chamber.

5. An air-jet furnace as claimed in claim 1 wherein said vertical chamber includes an annular projection means formed in the wall of said vertical chamber for mounting said stabilizer means in the inner space of said vertical chamber.

* * * * *